US012275555B2

(12) United States Patent
Suehiro

(10) Patent No.: US 12,275,555 B2
(45) Date of Patent: Apr. 15, 2025

(54) PALLET COMPONENT STRUCTURE AND PACKAGING SYSTEM

(71) Applicant: Shinya Suehiro, Kanagawa (JP)

(72) Inventor: Shinya Suehiro, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 249 days.

(21) Appl. No.: 17/977,365

(22) Filed: Oct. 31, 2022

(65) Prior Publication Data

US 2023/0144970 A1 May 11, 2023

(30) Foreign Application Priority Data

Nov. 9, 2021 (JP) ..... 2021-182457

(51) Int. Cl.

| | |
|---|---|
| ***B65D 19/00*** | (2006.01) |
| ***B65D 19/14*** | (2006.01) |
| ***B65D 19/20*** | (2006.01) |
| ***B65D 85/68*** | (2006.01) |

(52) U.S. Cl.

CPC ..... *B65D 19/20* (2013.01); *B65D 19/14* (2013.01); *B65D 85/68* (2013.01); *B65D 2519/00029* (2013.01); *B65D 2519/00159* (2013.01); *B65D 2519/00273* (2013.01); *B65D 2519/00532* (2013.01); *B65D 2519/00562* (2013.01); *B65D 2519/00572* (2013.01); *B65D 2519/00875* (2013.01); *B65D 2585/689* (2013.01)

(58) Field of Classification Search

CPC ..... B65D 19/20; B65D 19/14; B65D 85/68; B65D 2519/00029; B65D 2519/00159; B65D 2519/00273; B65D 2519/00532; B65D 2519/00562; B65D 2519/00572; B65D 2519/00875; B65D 2585/689

USPC ..... 206/386, 600

See application file for complete search history.

(56) References Cited

U.S. PATENT DOCUMENTS

| | | | | | |
|---|---|---|---|---|---|
| 2,534,011 | A * | 12/1950 | Frye | B65D 5/3642 | 206/599 |
| 4,373,637 | A * | 2/1983 | Shippell | B65D 19/06 | 229/117.02 |
| 4,606,461 | A * | 8/1986 | Bolton, Sr. | B65D 19/20 | 229/117.02 |
| 4,691,859 | A * | 9/1987 | Snyder | B65D 5/326 | 229/117.02 |

(Continued)

FOREIGN PATENT DOCUMENTS

| | | |
|---|---|---|
| JP | 8-011883 | 1/1996 |
| JP | H09-301342 A | 11/1997 |

(Continued)

OTHER PUBLICATIONS

Chinese Office Action for Chinese Application No. 202211025224.9 dated Mar. 22, 2024.

*Primary Examiner* — Luan K Bui

(74) *Attorney, Agent, or Firm* — Harness, Dickey & Pierce, P.L.C.

(57) ABSTRACT

A pallet component structure body is for loading a packaged object. The pallet component structure body includes a pallet component and a frame structure forming component. The frame structure forming component is secured on the pallet component. The frame structure forming component is foldable flat in a state where adjacent ones of frame structure parts of the frame structure forming component are joined in advance.

16 Claims, 8 Drawing Sheets

(56) References Cited

U.S. PATENT DOCUMENTS

| | | | | | |
|---|---|---|---|---|---|
| 4,949,898 | A * | 8/1990 | Nederveld | B65D 19/20 | 229/117.02 |
| 5,934,474 | A * | 8/1999 | Renninger | B65D 19/20 | 206/600 |
| 6,050,410 | A * | 4/2000 | Quirion | B65D 19/20 | 229/117.02 |
| 6,902,061 | B1 * | 6/2005 | Elstone | B65D 19/02 | 206/596 |
| 2007/0023319 | A1 * | 2/2007 | Honkawa | A47F 3/142 | 206/600 |
| 2010/0213088 | A1 | 8/2010 | Goda | | |
| 2014/0353365 | A1 | 12/2014 | Nogi | | |
| 2016/0107789 | A1 * | 4/2016 | Itano | B65D 5/32 | 206/386 |
| 2021/0387765 | A1 | 12/2021 | Suehiro | | |
| 2021/0394950 | A1 | 12/2021 | Suehiro | | |

FOREIGN PATENT DOCUMENTS

| | | | |
|---|---|---|---|
| JP | 2002-225868 | | 8/2002 |
| JP | 2003-170961 | | 6/2003 |
| JP | 2005-289420 | A | 10/2005 |
| JP | 2010-195411 | | 9/2010 |
| JP | 3190092 | U | 4/2014 |
| JP | 2014-231369 | | 12/2014 |
| JP | 3196109 | | 1/2015 |
| JP | 2019-156454 | A | 9/2019 |

* cited by examiner

PALLET COMPONENT STRUCTURE AND PACKAGING SYSTEM

CROSS-REFERENCE TO RELATED APPLICATION

This patent application is based on and claims priority pursuant to 35 U.S.C. § 119(a) to Japanese Patent Application No. 2021-182457, filed on Nov. 9, 2021, in the Japan Patent Office, the entire disclosure of which is incorporated by reference herein.

BACKGROUND

Technical Field

Embodiments of the present disclosure relate to a pallet component structure body and a packaging system.

Discussion of the Background Art

As an example of a pallet component structure body and a packaging system, a pallet component is known on which a packaged cargo or a packaged object is loaded and which enables transportation in a unit load form. Further, a technology has been proposed to prevent a packing box placed on a pallet from displacing during loading/unloading work and transportation, and to improve strength characteristics of a paper pallet while saving the amount of paper used as much as possible. In this case, the paper pallet has a structure in which the core of a top plate is wrapped with a surrounding plate, a spacer is enclosed in a rectangular tube body formed by connecting the top plate, bottom plate, and both side plates, and the spacer has a structure in which a vertically oriented paper tube is wrapped in a horizontally oriented rectangular tube, and a plurality of rows of reinforcement bands is attached to the lower surface of the bottom plate.

SUMMARY

According to an embodiment of the present disclosure, there is provided a pallet component structure body for loading a packaged object. The pallet component structure body includes a pallet component and a frame structure forming component. The frame structure forming component is secured on the pallet component. The frame structure forming component is foldable flat in a state where adjacent ones of frame structure parts of the frame structure forming component are joined in advance.

According to another embodiment of the present disclosure, there is provided a packaging system that includes the pallet component structure body and the packaged object loaded on the pallet component structure body. The packaged object is an image forming apparatus.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
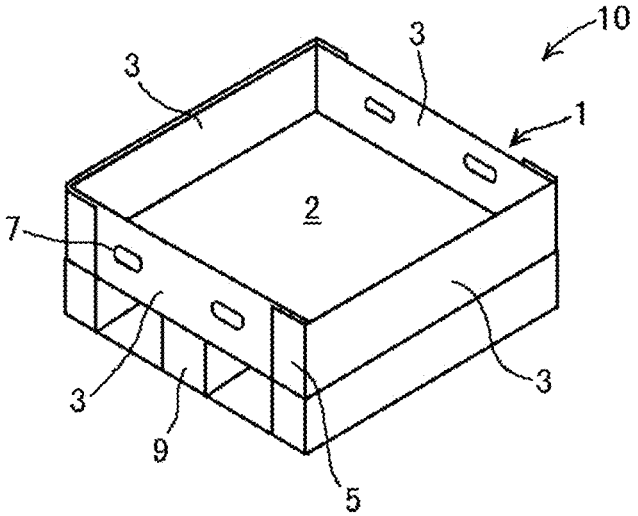
FIG. 1 is a schematic perspective view of a pallet component structure body according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
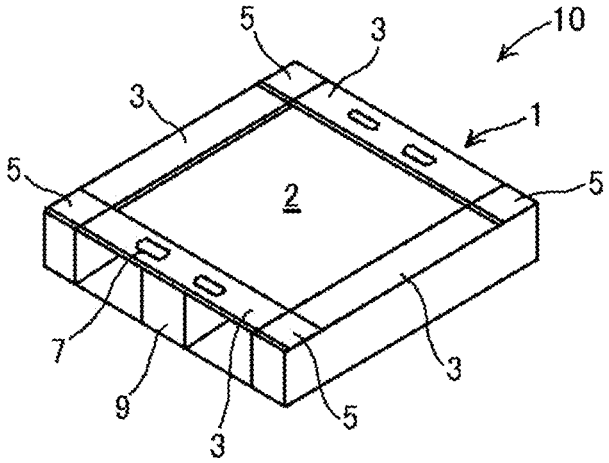
FIG. 2 is a schematic perspective view of the pallet component structure body according to the embodiment of the present disclosure.

FIGS. 1 and 2 are schematic perspective views of a pallet component structure body 10 according to an embodiment of the present disclosure.

The pallet component structure body 10 according to the embodiment of the present disclosure is a pallet component structure body 10 for loading a packaged object 25 (FIG. 13), and includes a pallet component 9 and a flat-foldable frame structure forming component 1 fixed on the pallet component 9. The frame structure forming component 1 according to the embodiment of the present disclosure has a bottom surface 2 and four side walls 3 adjacent to the outer periphery of the bottom surface 2, and is located on the pallet component 9.

Referring to FIG. 1, the side walls 3 of the frame structure forming component 1 are raised, and the frame structure forming component 1 forms a frame structure body raised along the four sides of the outer periphery of the pallet component 9. On the other hand, referring to FIG. 2, the side walls 3 of the frame structure forming component 1 are folded inward, and the frame structure forming component 1 stays within the pallet component 9 without protruding from the area of the pallet component 9 in plan view. That is, the frame structure forming component 1 can be folded flat in a state in which adjacent frame structure parts of the frame structure forming component 1 are joined in advance by the joining parts 5.

The pallet component 9 includes a lower plate, a block member arranged on the lower plate, an upper plate arranged on the block member, and the like. The pallet component 9 has a fork insertion port for inserting a fork of a forklift. The detailed structure of the pallet component is described in, for example, the U.S. patent application publication No. 2010/0213088, which is herein incorporated by reference in its entirety.

The frame structure forming component 1 is fixed onto a deck board plate member constituting a plane of the pallet component 9 with screws or the like.

Referring to FIG. 1, two each adjacent side walls 3 are simply joined to each other with the joining part 5 which is a part of the side wall 3 by the pallet manufacturer using a glue, stitcher, or the like. Since the joining parts 5 are joined by the pallet manufacturer, the manufacturer of the packaged object 25, which is the user, is not required to perform the joining work.

Figure 13:
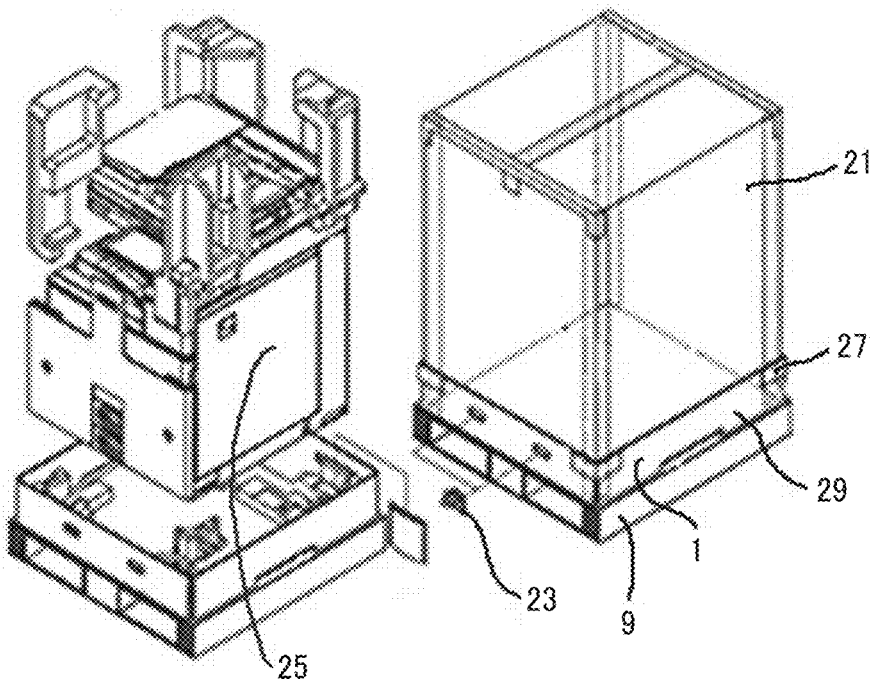
FIG. 13 is a schematic perspective view of a packaged object stored in a pallet component structure body according to a comparative example and an outer box covering the packaged object.

On the other hand, for example, in the comparative example illustrated in FIG. 13, a sheet component on a deck board of a pallet component 9 on which a packaged cargo or a packaged object 25 is loaded and which enables transportation in a unit load form. The sheet component is folded and fixed to form frame structure parts 29 that are raised along the four sides of the outer periphery of the pallet component 9. The frame structure parts 29 constituting the side walls of the four sides sufficiently restrict the packaged cargo or the packaged object 25 loaded on the pallet component 9 from moving in the front-rear and left-right directions due to vibration or impact during transportation. In addition, joining the frame structure parts 29 with an outer box 21 further restricts the movement of the outer box 21.

In addition, the frame structure forming component 1 constituting such frame structure parts 29 may be made of one sheet-shaped component. For example, in the example illustrated in FIGS. 14 and 15, the frame structure part 29 are formed by forming side walls by raising the four sides of outer periphery of the sheet component and then joining the side walls by additional processing using fixing units 27 such as bonding components, joining components, or a bonding agent.

If the frame structure part of the pallet component structure including the pallet component 9 and the frame structure forming component 1 are formed and fixed at the time of manufacturing at the pallet manufacturer, stacked pallet component structure bodies may be of a great height while the pallet component structure bodies are distributed from the pallet manufacturer to the manufacturer of a packaged object 25. Consequently, the number of loading stages of the pallet component structure bodies at the time of transportation decreases, the number of the pallet component structure bodies transported at the time of truck transportation decreases, and the transportation cost increases.

Figure 16:
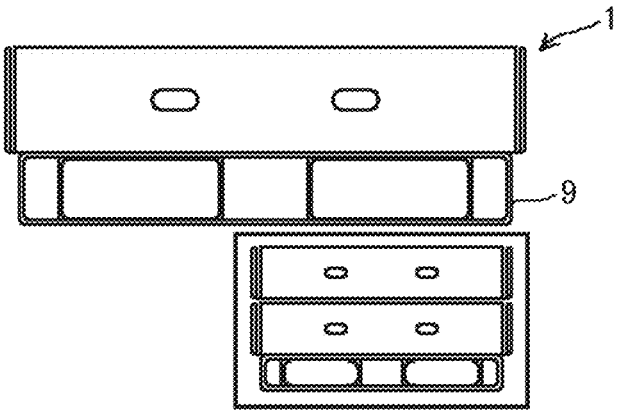
FIG. 16 is a schematic view of the pallet component structure body of FIG. 14.

As a countermeasure against this disadvantage, as in the example illustrated in FIG. 16, pallet component structure bodies of different sizes may be stacked, specifically, a pallet component structure immediately of a relatively small size may be located below a certain pallet component structure body. In this case, however, the upper exterior box is not completely placed on the lower pallet component structure body, and the pressure strength of an outer box 21 may be impaired. In addition, a frame structure forming component 1 protrudes outward from the lower pallet component structure body, so that the frame structure forming component 1 may come into contact with other cargo and suffer damage.

Figure 14:
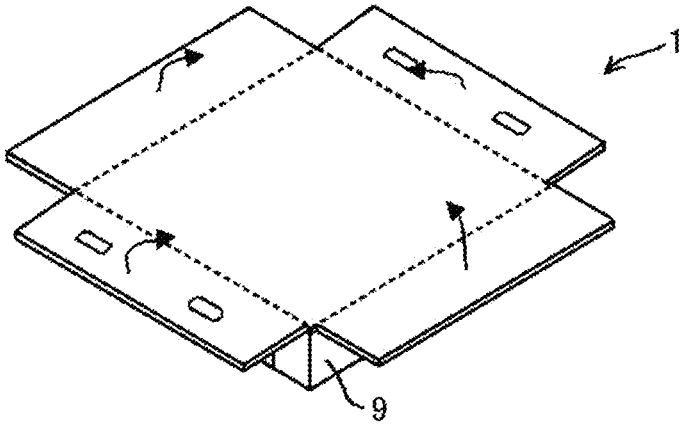
FIG. 14 is a schematic perspective view of a pallet component structure body according to a comparative example.
Figure 15:
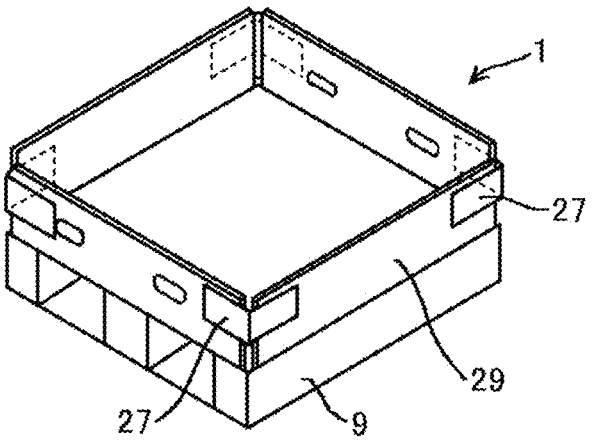
FIG. 15 is a schematic perspective view of the pallet component structure body of FIG. 14.

For this reason, as in the example illustrated in FIG. 14, a pallet component structure body may be transported with side walls opened without raising. In such a case, the manufacturer of a packaged object 25 who is a user raises the side walls of the pallet component structure body at the time of use, and joins the side walls by additional processing work such as bonding with tapes to form the frame structure parts 29. Such additional processing work may be a burden on the user.

Figure 17:
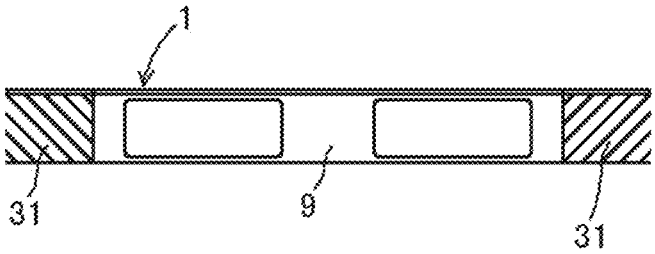
FIG. 17 is a schematic front view of dead spaces created by the pallet component structure body of FIG. 14.

In this case, as illustrated in FIG. 17, in the pallet component structure body and the transportation mode thereof, there are generated dead spaces 31 indicated by hatching immediately below the side walls due to the opened side walls. Therefore, the loading efficiency may decrease at the time of truck transportation although not as much as the decrease in the number of stacking stages due to the raised side walls. In addition, the thin side walls in a protruding state might be damaged due to contact with other cargo during distribution.

Figure 3:
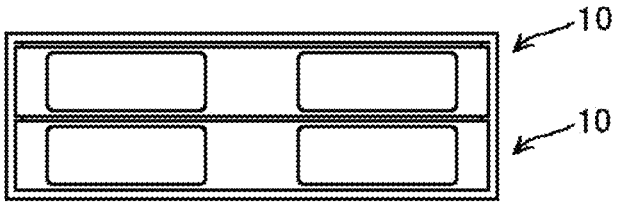
FIG. 3 is a schematic front view of a state in which the pallet component structure bodies according to the embodiment of the present disclosure are loaded.

FIG. 3 is a schematic front view of a state in which the pallet component structure bodies 10 according to the embodiment of the present disclosure are loaded.

As illustrated, according to the present embodiment, the pallet component structure bodies 10 can be loaded without generating dead spaces 31 (see, e.g., FIG. 17) in the left-right direction.

According to the pallet component structure body 10 according to the present embodiment, the above-described disadvantages can be solved by the following factors.

- As illustrated in FIG. 2, since the frame structure forming component 1 can be folded inward at the time of distribution, it is possible to eliminate dead spaces at the time of transportation as illustrated in FIG. 3, thereby improving the loading efficiency at the time of truck transportation.
- As illustrated in FIG. 2, since the frame structure forming component 1 can be folded inward at the time of distribution, the thin side walls 3 are placed on the upper plate of the pallet component 9 without contact with other cargo, so that it is possible to prevent damage to the side walls 3.

Since the frame structure forming component 1 is folded flat in a state where the adjacent frame structure parts (specifically, the side walls 3) of the frame structure forming component 1 are joined together in advance, it is not necessary to add a complicated processing work of joining the four corners in order to form the frame structure after raising the side walls. Since the four side walls 3 rise in conjunction with each other (semi-automatically), the frame structure parts can be easily formed. Therefore, it is possible to simplify the work that puts a heavy burden on the human operator, and also simplify the work process by a robot.

Figure 4A:
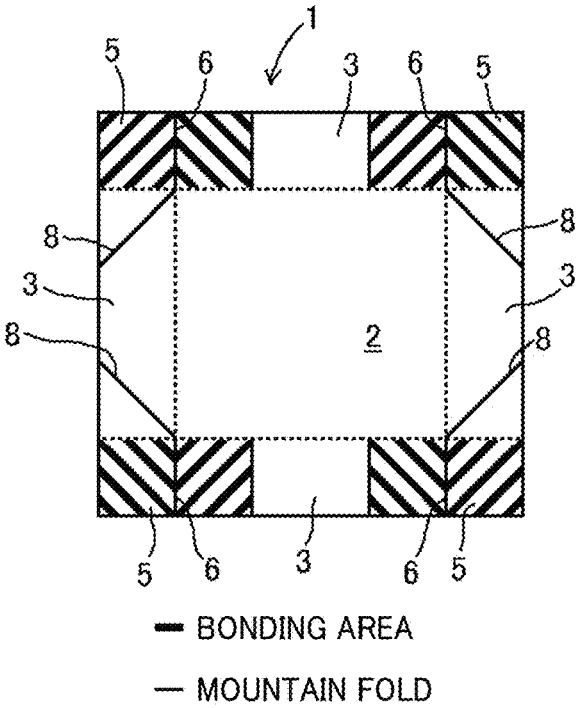
FIGS. 4A and 4B are schematic plan views of a frame structure forming component according to a first embodiment of the present disclosure.
Figure 4B:
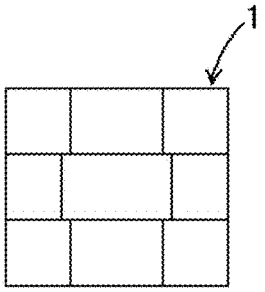

FIGS. 4A and 4B are schematic plan views of the frame structure forming component 1 according to a first embodiment of the present disclosure. FIG. 4A is a schematic plan view of the frame structure forming component 1 before joining, and FIG. 4B is a schematic plan view of the folded frame structure forming component 1.

Referring to FIG. 4A, the frame structure forming component 1 has a square shape as a whole, and includes the bottom surface 2, the four side walls 3 forming frame structure parts adjacent to an outer periphery of the bottom surface 2, the joining parts 5 for joining four corners of the frame structure forming component 1, and fold lines 8 for folding the side walls 3. As illustrated in the drawing, the frame structure forming component 1 has four cuts 6 extending in parallel with the left and right sides of the frame structure forming component 1. Therefore, the frame structure forming component 1 has the joining parts 5 at the four corners where the left and right side walls 3 are positioned vertically. FIG. 4A is a development view of the frame structure forming component 1, where these joining parts 5 are joined in advance to a part of the side walls 3 adjacent to each other with the cut 6 in between. Hatched sections in the drawing are overlapping regions/joining regions of the joining parts 5 and the side walls 3 adjacent thereto. The cuts 6 before joining are formed as slits and have no width.

Two fold lines 8 are obliquely formed on the two each opposing side walls 3 in order to fold the side walls 3 forming the frame structure parts, and function as mountain fold lines at the time of folding in plan view. Dotted lines in the drawing function as valley fold lines. That is, in a state where the joining parts 5 are joined, making valley folds along the dotted line and making mountain folds along the fold lines 8 forms a folded state as illustrated in FIG. 4B. By making mountain folds along the fold lines 8, the side walls 3 of the frame structure forming component 1 can be entirely folded inside the pallet component 9 (see, e.g., FIG. 4B).

Figure 5A:
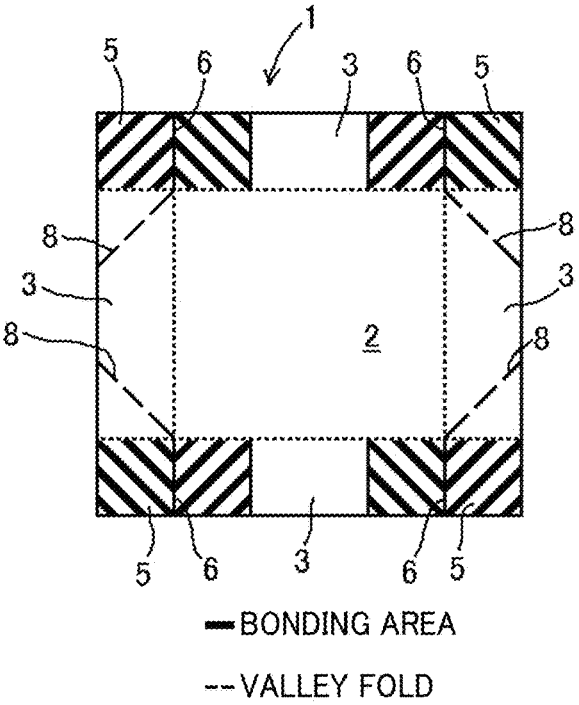
FIGS. 5A and 5B are schematic plan views of a frame structure forming component according to a second embodiment of the present disclosure.
Figure 5B:
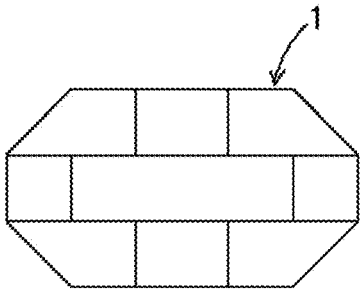

FIGS. 5A and 5B are schematic plan views of a frame structure forming component 1 according to a second embodiment of the present disclosure. FIG. 5A is a schematic plan view of the frame structure forming component 1 before joining, and FIG. 5B is a schematic plan view of the folded frame structure forming component 1.

Two fold lines 8 for folding are obliquely formed on the two each opposing side walls 3 in order to fold the side walls 3 forming the frame structure parts, and function as valley fold lines at the time of folding in plan view. Dotted lines in the drawing function as valley fold lines. That is, in a state where the joining parts 5 are joined, making valley folds along the dotted line and making valley folds along the fold lines 8 forms a folded state as illustrated in FIG. 5B. By making valley folds along the fold lines 8, the upper and lower side walls 3 of the frame structure forming component 1 are folded inside the pallet component 9, and the left and right side walls 3 are folded outside the pallet component 9 (see, e.g., FIG. 5B). This also makes it possible to eliminate left and right dead spaces as illustrated in FIG. 17. That is, the pallet component structure bodies 10 can be arranged adjacent to each other in the vertical direction in FIGS. 5A and 5B, and the pallet component structure bodies 10 can also be stacked in the height direction as illustrated in FIG. 3.

Figure 6A:
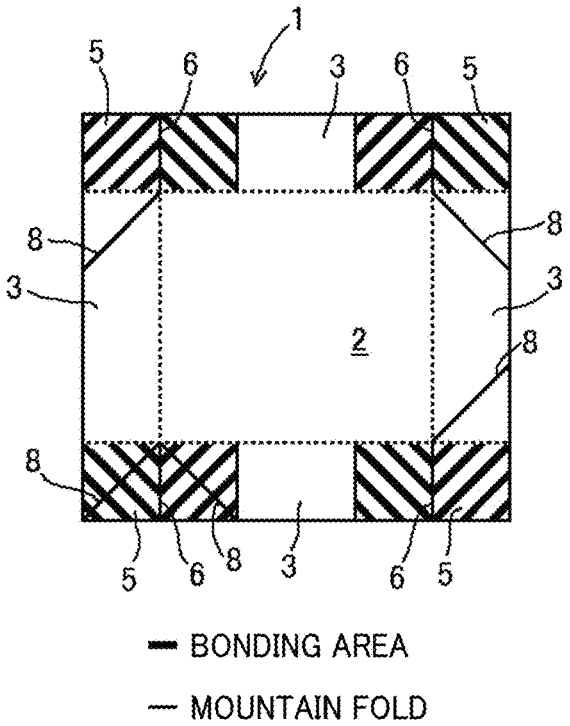
FIGS. 6A and 6B are schematic plan views of a frame structure forming component according to a third embodiment of the present disclosure.
Figure 6B:
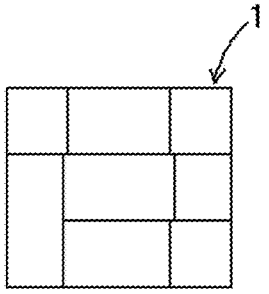

FIGS. 6A and 6B are schematic plan views of a frame structure forming component 1 according to a third embodiment of the present disclosure. FIG. 6A is a schematic plan view of the frame structure forming component 1 before joining, and FIG. 6B is a schematic plan view of the folded frame structure forming component 1.

In the present embodiment, unlike the first embodiment illustrated in FIGS. 4A and 4B, in order to fold the side walls 3 forming the frame structure parts, one fold line 8 is obliquely provided on a joining part 5 in a side wall 3 having the joining part 5, one fold line 8 is obliquely provided on the side wall 3, two fold lines 8 are obliquely provided on a side wall 3 opposing to the side wall 3, and one fold line 8 is obliquely provided on a side wall 3 adjacent to the joining part 5 having the fold line 8 with a cut 6 in between. These fold lines function as mountain fold lines. Dotted lines in the drawing function as valley fold lines. That is, in a state where the joining parts 5 are joined, making valley folds along the dotted line and making mountain folds along the fold lines 8 forms a folded state as illustrated in FIG. 6B. As a result, since each of the four side walls 3 is folded on the adjacent side wall 3 (see, e.g., FIG. 6B), the posture of the side walls 3 in the folded state is stably fixed during storage or transportation of the components.

According to the frame structure forming components 1 according to the first to third embodiments described above, the joining parts 5 for joining the four corners of the frame structure forming component 1 have a square shape. This allows the four corners of the frame structure forming component 1 to be joined with a sufficient area, thereby securing a sufficient fixing force.

Figure 7A:
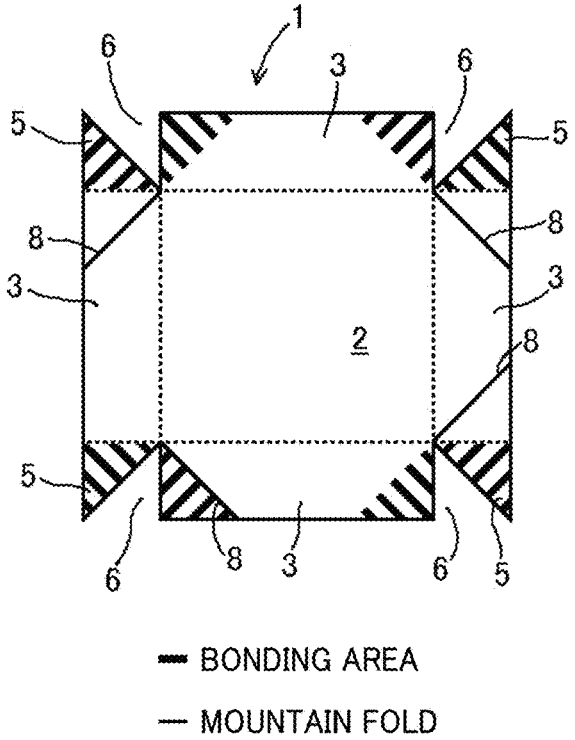
FIGS. 7A and 7B are schematic plan views of a frame structure forming component according to a fourth embodiment of the present disclosure.
Figure 7B:
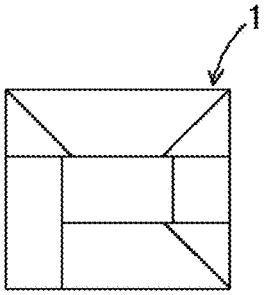

FIGS. 7A and 7B are schematic plan views of a frame structure forming component 1 according to a fourth embodiment of the present disclosure. FIG. 7A is a schematic plan view of the frame structure forming component 1 before joining, and FIG. 7B is a schematic plan view of the folded frame structure forming component 1.

In the present embodiment, unlike the first embodiment in FIGS. 4A and 4B, cuts 6 have a triangular shape, and similarly, joining part 5 also have a triangular shape. Each joining part 5 overlaps a part of an adjacent side wall 3 with the cut 6 therebetween in the hatched section, and is fixed to each other in advance by using a glue, a stitcher, or the like.

In order to fold the side walls 3 forming frame structure parts, one fold line 8 is obliquely formed on the left side wall 3, and two oblique fold lines 8 are formed on the opposing right side wall 3. These fold lines 8 function as mountain fold lines. Dotted lines in the drawing function as valley fold lines. That is, in a state where the joining parts 5 are joined, making valley folds along the dotted line and making mountain folds along the fold lines 8 forms a folded state as illustrated in FIG. 7B. By making mountain folds along the fold lines 8, the side walls 3 of the frame structure forming component 1 can be entirely folded inside a pallet component 9 (see, e.g., FIG. 7B).

According to the frame structure forming component 1 according to the fourth embodiment, the joining parts 5 for joining the four corners of the frame structure forming component 1 have a triangular shape. Making the triangular cuts 6 for forming the triangular joining parts 5 decreases by one the number of joining parts 5 overlapping at the time of folding of the joining parts 5 as compared with the case of the square shape, so that it is possible to suppress the instability of the posture due to the overlapping at the time of folding.

As illustrated in FIG. 1, according to the embodiments of the present disclosure, the side walls 3 forming the frame structure parts include joining holes 7 to receive insertion of joining components 23 for joining the side walls 3 to the outer box 21. This allows the frame structure forming component 1 and the outer box 21 to be joined to each other by the joining components 23, so that the frame structure forming component 1 and the outer box 21 can be firmly fixed to each other (see, e.g., FIG. 13).

Figure 8:
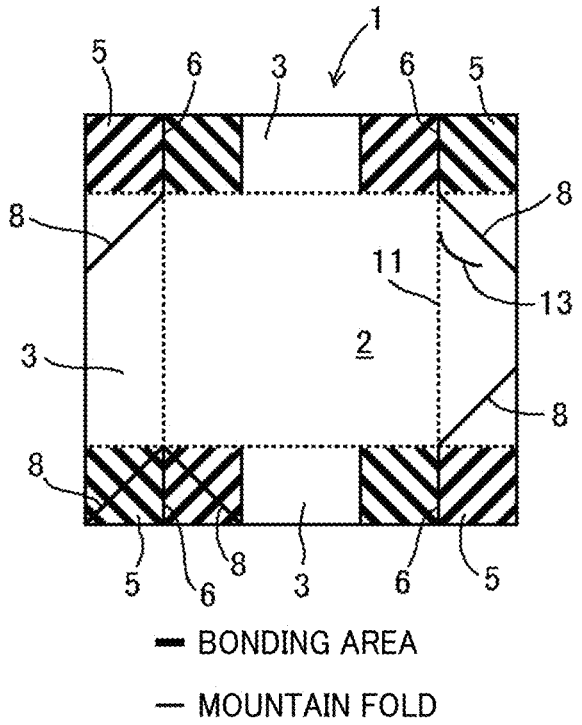
FIG. 8 is a schematic plan view of a frame structure forming component according to a fifth embodiment of the present disclosure.

FIG. 8 is a schematic plan view of a frame structure forming component 1 according to a fifth embodiment of the present disclosure. FIG. 8 is a schematic plan view of the frame structure forming component 1 before joining.

Figure 9A:
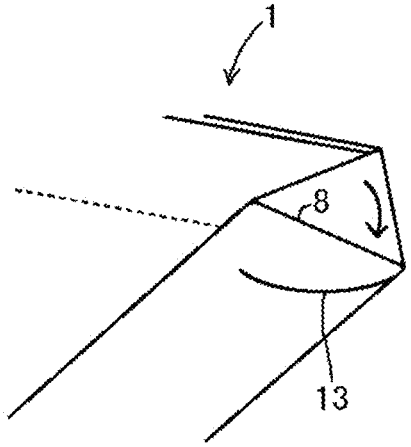
FIGS. 9A and 9B are schematic views of a main part of the frame structure forming component according to the present embodiment.
Figure 9B:
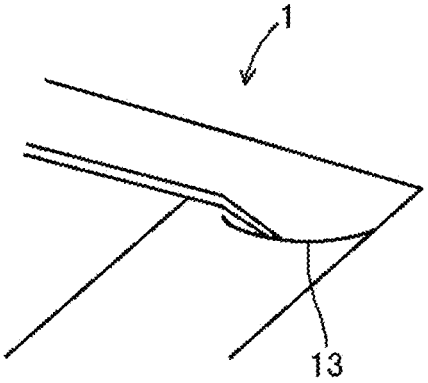

FIGS. 9A and 9B are schematic views of a main part of the frame structure forming component 1 according to the fifth embodiment. FIG. 9A is a schematic perspective view of the raised frame structure forming component 1, and FIG. 9B is a schematic perspective view of the folded frame structure forming component 1.

As illustrated in FIG. 8, a side wall 3 forming a frame structure part has a slit 13 to receive insertion of a joining part 5 at the time of folding. The slit 13 extends in an arc shape from a joining part 11 between a bottom surface 2 and the side wall 3 adjacent to the bottom surface 2 toward the outside of the side wall 3. Accordingly, as illustrated in FIG. 9A, when the raised side wall 3 is folded to make a valley fold along the fold line 8, the corner of the raised side wall 3 can be inserted into the slit 13 as illustrated in FIG. 9B. As a result, the folded state of the side wall 3 can be maintained by being inserted into the slit 13.

Figure 10:
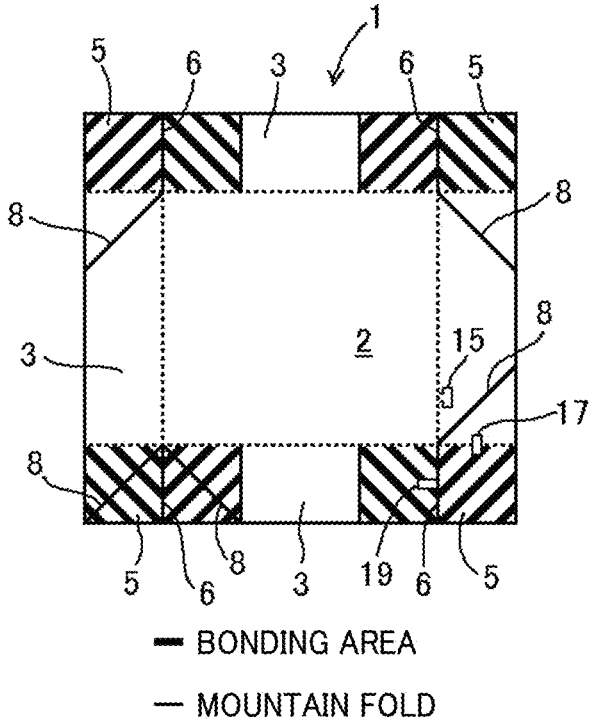
FIG. 10 is a schematic plan view of a frame structure forming component according to a sixth embodiment of the present disclosure.

FIG. 10 is a schematic plan view of a frame structure forming component 1 according to a sixth embodiment of the present disclosure. FIG. 10 is a schematic plan view of the frame structure forming component 1 before joining.

Figure 11A:
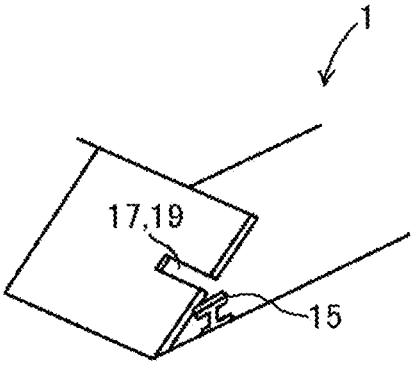
FIGS. 11A and 11B are schematic views of a main part of the frame structure forming component according to the present embodiment.
Figure 11B:
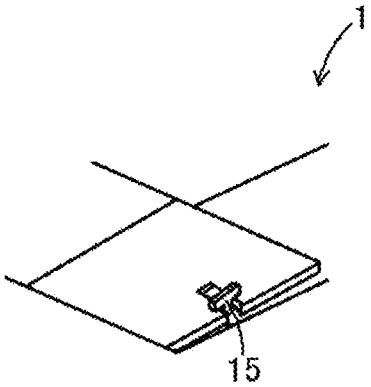

FIGS. 11A and 11B are schematic views of a main part of the frame structure forming component 1 according to the present embodiment.

As illustrated in FIG. 10, a side wall 3 forming a frame structure part has a fixing part 15 for fixing the side walls 3 to each other and two insertion holes 17 and 19 to receive insertion of the fixing part 15. The insertion holes 17 and 19 are provided at positions overlapping the fixing part 15 when the side wall 3 is folded. The fixing part 15 has a T-shape. As a result, as illustrated in FIGS. 11A and 11B, when the frame structure forming component 1 is folded, the fixing part 15 can be raised and inserted into the two insertion holes 17 and 19, and the folded state of the side wall 3 can be hooked and held on the T-shaped portion of the fixing part 15.

Referring to FIG. 1, in the frame structure forming component 1 according to the embodiment of the present disclosure, the joining parts 5 for joining four corners of the frame structure forming component 1 are overlapped and joined to the outside of the side walls 3. Since the joining parts 5 for joining the four corners of the frame structure forming component 1 do not enter the inside of the frame structure parts, it is possible to secure a sufficient storage space inside the frame structure parts.

Figure 12:
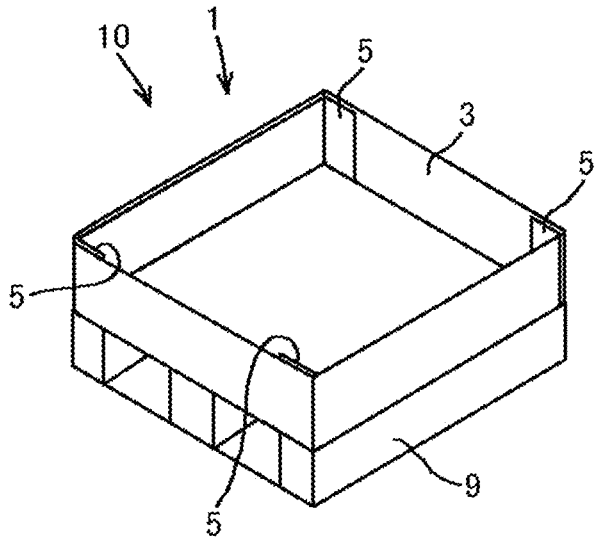
FIG. 12 is a schematic perspective view of a frame structure forming component according to another embodiment of the present disclosure.

FIG. 12 is a schematic perspective view of a frame structure forming component 1 according to another embodiment of the present disclosure.

As illustrated, joining parts 5 for joining the four corners of the frame structure forming component 1 are overlapped with and joined to the inside of the side walls 3. Since the joining parts 5 for joining the four corners of the frame structure forming component 1 do not protrude to the outside of the frame structure parts, it is possible to suppress interference of the joining parts 5 (damage due to friction or the like) when a certain pallet component is transported side by side with another pallet component.

The frame structure forming component 1 according to the embodiment of the present disclosure is formed of corrugated cardboard. Since the frame structure forming component 1 is made of cardboard which is a material having excellent cyclability, it is possible to promote the recycling of the pallet component structure body 10.

In the frame structure forming component 1 according to the embodiment of the present disclosure, the joining parts 5 for joining the four corners of the frame structure forming component 1 are joined with stitches. This makes it possible to secure a sufficient force for fixing the side walls 3 of the frame structure forming component 1.

In the frame structure forming component 1 according to the embodiment of the present disclosure, the joining parts 5 for joining the four corners of the frame structure forming component 1 are joined with an adhesive. As a result, it is not necessary to use a joining component made of a material different from that of the frame structure forming component 1, and this eliminates the need to perform disassembly and separation work at the time of discarding the frame structure forming component 1.

In the pallet component structure body 10 according to the embodiment of the present disclosure, the pallet component 9 as a pallet base structure is a pallet made of cardboard.

In the pallet component structure body 10 according to the embodiment of the present disclosure, the pallet component 9 is a plywood pallet. Since the plywood pallet has high rigidity, the highly rigid pallet component structure body 10 can be realized.

In the pallet component structure body 10 according to the embodiment of the present disclosure, the frame structure forming component 1 and the pallet component 9 are joined with an adhesive. As a result, it is not necessary to use a joining component made of a material different from that of the frame structure forming component 1, and this eliminates the need to perform disassembly and separation work at the time of discarding the frame structure forming component 1.

In the pallet component structure body 10 according to the embodiment of the present disclosure, the frame structure forming component 1 and the pallet component 9 are joined with stitches. This makes it possible to secure a strong fixing force.

In the pallet component structure body 10 according to the embodiment of the present disclosure, the frame structure forming component 1 and the pallet component 9 are joined by screwing. This makes it possible to secure a strong fixing force.

Further, according to the embodiment of the present disclosure, in the packaging system including the pallet component structure body 10 and the packaged object 25 loaded on the pallet component structure body 10, the packaged object 25 is an image forming apparatus.

As described above, according to the present disclosure, the following effects can be obtained.

It is possible to eliminate the dead spaces 31 (see, e.g., FIG. 17) at the time of transportation of the pallet component structure body 10 unlike in the related art, thereby improving the loading efficiency at the time of truck transportation (see, e.g., FIG. 3).

Since the thin side walls 3 are placed on the top plate of the pallet component 9 and do not come into contact with other cargo unlike in the related art, it is possible to prevent damage to the side walls 3 (see, e.g., FIG. 2).

It is not necessary to perform an additional processing work of joining the four corners in order to raise the side walls 3 to form the frame structure parts unlike in the related art, the side walls 3 on the four sides can be semi-automatically raised. Therefore, since the frame structure parts can be easily formed, it is possible to eliminate a high-load work for the worker, and easily achieve the automation of work process by a robot.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A pallet component structure body for loading a packaged object, the pallet component structure body comprising:

a pallet component; and a frame structure forming component secured on the pallet component, the frame structure forming component being foldable flat in a state where adjacent ones of frame structure parts of the frame structure forming component are joined in advance, wherein the frame structure forming component includes:

a bottom surface, four side walls adjacent to an outer periphery of the bottom surface, the four side walls forming the frame structure parts, joining parts that join four corners of the frame structure forming component, and fold lines along which the four side walls are foldable, wherein each of the joining parts is adjacent to one side wall of the four side walls and joined to a portion of the one side wall, wherein a first fold line of the fold lines is obliquely provided on one joining part, of the joining parts, in a first side wall of the four side walls, wherein a second fold line of the fold lines is obliquely provided on the first side wall, a third fold line and a fourth fold line of the fold lines are obliquely provided on a second side wall opposite the first side wall, and wherein a fifth fold line of the fold lines is obliquely provided on a third side wall of the four side walls, and the third side wall is adjacent to the one joining part, on which the first fold line is provided, with a cut interposed between the third side wall and the one joining part.

2. The pallet component structure body according to claim 1, wherein the second, third and fourth fold lines are foldable as mountain fold lines in plan view.

3. The pallet component structure body according to claim 1, wherein the joining parts have a square shape.

4. The pallet component structure body according to claim 1, wherein the four side walls include a joining hole into which a joining component is insertable and configured to join the four side walls to an outer box.

5. The pallet component structure body according to claim 1, wherein one of the four side walls includes a slit to receive one of the joining parts at a time of folding.

6. The pallet component structure body according to claim 1, wherein the joining parts are overlapped and joined to outside of the four side walls.

7. The pallet component structure body according to claim 1, wherein the joining parts are overlapped and joined to inside of the four side walls.

8. The pallet component structure body according to claim 1, wherein the frame structure forming component is made of cardboard.

9. The pallet component structure body according to claim 1, wherein the joining parts are joined with stitches.

10. The pallet component structure body according to claim 1, wherein the joining parts are joined with an adhesive.

11. The pallet component structure body according to claim 1, wherein the pallet component is a pallet made of cardboard.

12. The pallet component structure body according to claim 1, wherein the pallet component is a pallet made of plywood.

13. The pallet component structure body according to claim 1, wherein the frame structure forming component and the pallet component are joined with an adhesive.

14. The pallet component structure body according to claim 1, wherein the frame structure forming component and the pallet component are joined with stitches or a screw.

15. A packaging system, comprising:

the pallet component structure body according to claim 1; and the packaged object loaded on the pallet component structure body, wherein the packaged object is an image forming apparatus.

16. A pallet component structure body for loading a packaged object, the pallet component structure body comprising:

a pallet component; and a frame structure forming component secured on the pallet component, the frame structure forming component being foldable flat in a state where adjacent ones of frame structure parts of the frame structure forming component are joined in advance, wherein the frame structure forming component includes:

a bottom surface, four side walls adjacent to an outer periphery of the bottom surface, the four side walls forming the frame structure parts, joining parts that join four corners of the frame structure forming component, and fold lines along which the four side walls are foldable, wherein each of the joining parts is adjacent to one side wall of the four side walls and joined to a portion of the one side wall, and wherein a first side wall of the four side walls includes a T-shaped fixing part extended therefrom and configured to fix an adjacent side wall of the four side walls to the first side wall, and the adjacent side wall includes an insertion hole configured to receive the T-shaped fixing part.

* * * * *